US006427984B1

(12) United States Patent
Mulvaney et al.

(10) Patent No.: US 6,427,984 B1
(45) Date of Patent: Aug. 6, 2002

(54) EVAPORATIVE HUMIDIFIER

(75) Inventors: Patrick T Mulvaney; Michael E. Smith, both of Glen Allen, VA (US); Anthony V. Cruz, Westlake Village, CA (US)

(73) Assignee: Hamilton Beach/Proctor-Silex, Inc., Glen Allen, VA (US)

( * ) Notice: Subject to any disclaimer, the term of this patent is extended or adjusted under 35 U.S.C. 154(b) by 0 days.

(21) Appl. No.: 09/637,484

(22) Filed: Aug. 11, 2000

(51) Int. Cl.[7] ..... B01F 3/04
(52) U.S. Cl. ..... 261/70; 261/72.1; 261/107
(58) Field of Search ..... 261/70, 72.1, 95, 261/99, 104, 107, DIG. 41, DIG. 46, DIG. 65

(56) References Cited

U.S. PATENT DOCUMENTS

| | | | |
|---|---|---|---|
| 310,116 | A | 12/1884 | Beale |
| 1,625,663 | A | 4/1927 | Kelly |
| 2,032,634 | A | 3/1936 | Ross |
| 2,054,200 | A | 9/1936 | Langford |

(List continued on next page.)

FOREIGN PATENT DOCUMENTS

| | | |
|---|---|---|
| JP | 62194147 | 8/1987 |
| JP | 05187695 | 7/1993 |
| JP | 58158435 | 9/1993 |
| JP | 58158436 | 9/1993 |
| JP | 06300346 | 10/1994 |
| JP | 07332733 | 12/1995 |

OTHER PUBLICATIONS

Holmes, HM–3000 Rapid Mist Humidifier—Owner's Guide, approx. 1995.

Hunter Fan Company "The Healthy Humidifier Plus"; Jan. 1, 1997; 2 pgs.

"Honeywell Consumer Products: Parts and Accessories Finder," webpage at http://hcpretail.honeywell.com/HCP_Store/catalog/productdisplay.asp?subroupnum=33.

*Primary Examiner*—C. Scott Bushey
(74) *Attorney, Agent, or Firm*—Akin, Gump, Strauss, Hauer & Feld, L.L.P.

(57) ABSTRACT

An evaporative humidifier including a base removably supporting a water tray for holding a quantity of water. A blower assembly and a water tank are removably supported by the base above the water tray. The blower assembly includes a housing and a fan disposed intermediate a pair of air inlets and an air exhaust outlet. A cylindrically shaped wick filter is supported by the water tray and extends upwardly into the housing. The wick filter includes a cylindrical side wall and opposing open upper and lower ends. The fan is driven by a motor mounted inside the housing for drawing air into the housing through the air inlets, through the cylindrical side walls of the wick filter, and then through the open upper end of the wick filter and out of the housing through the air exhaust outlet. A float assembly is removably supported by the water tray and includes an vertically extending switch actuator vertically moveable with changing water levels in the water tray and selectively engagable with a float switch for deactivating the motor when the water level falls below a predetermined point. The water tank includes concave and convex side walls and a handle defining a pivot point wherein support of the tank by the handle causes the concave side wall to swing upwardly and outwardly toward the convex side wall.

4 Claims, 13 Drawing Sheets

U.S. PATENT DOCUMENTS 2,211,407 A 8/1940 Christensen
2,244,792 A 6/1941 Miller
2,424,268 A 7/1947 Delano
2,508,530 A 5/1950 Morris
2,680,914 A 6/1954 Smith
2,730,340 A 1/1956 Patriarca
2,752,134 A 6/1956 Paulus
2,774,581 A 12/1956 Bowersox
2,998,714 A 9/1961 Bonzer
3,045,450 A 7/1962 Chandler
3,253,820 A 5/1966 Seil
3,290,021 A 12/1966 Blachly et al.
3,322,405 A 5/1967 Knudson et al.
3,323,784 A 6/1967 Fazio
3,598,370 A 8/1971 Hoag
3,637,194 A 1/1972 Swimmer et al.
3,730,500 A 5/1973 Richards
3,799,517 A 3/1974 Tamm
3,811,661 A 5/1974 Procter
3,852,380 A 12/1974 Wiseman
3,914,349 A 10/1975 Stipanuk
3,990,848 A 11/1976 Corris
4,028,444 A 6/1977 Brown et al.
4,045,523 A 8/1977 Goettl
4,051,205 A 9/1977 Grant
4,056,582 A 11/1977 Chow
4,127,620 A 11/1978 Sherman et al.
4,169,261 A 9/1979 Alpaugh
4,192,832 A 3/1980 Goettl
4,225,542 A 9/1980 Wall et al.
4,234,526 A 11/1980 Mackay et al.
4,265,839 A 5/1981 Baus
4,286,751 A 9/1981 Fowler
4,289,713 A 9/1981 Goettl
4,333,887 A 6/1982 Goettl
4,355,636 A 10/1982 Oetjen et al.
4,361,522 A 11/1982 Goettl
4,428,207 A 1/1984 Hall
4,480,469 A 11/1984 Tice
4,563,313 A 1/1986 Tsuaki
4,576,013 A 3/1986 Sperr et al.
4,698,188 A 10/1987 Gutmann
4,719,057 A 1/1988 Mizoguchi
4,753,758 A 6/1988 Miller
4,820,453 A 4/1989 Huang
4,822,533 A 4/1989 Steiner et al.
4,839,014 A 6/1989 Park et al.
4,853,161 A 8/1989 Huang
4,865,775 A 9/1989 Steiner et al.
4,906,417 A 3/1990 Gentry
4,932,218 A 6/1990 Robbins
5,014,338 A 5/1991 Glucksman
5,015,420 A 5/1991 Jones
5,034,162 A 7/1991 Chiu
5,037,583 A 8/1991 Hand
5,037,586 A 8/1991 Mehrholz et al.
5,061,405 A 10/1991 Stanek et al.
5,108,663 A 4/1992 Chiu
5,110,511 A 5/1992 Hand
5,111,529 A 5/1992 Glucksman
5,133,904 A 7/1992 Pepper
5,143,655 A 9/1992 Chiu et al.
5,143,656 A 9/1992 Marino et al.
5,210,818 A 5/1993 Wang
5,231,979 A 8/1993 Rose et al.
5,250,232 A 10/1993 Pepper et al.
5,252,260 A 10/1993 Schuman
5,373,841 A 12/1994 Kyllonen et al.
5,374,380 A 12/1994 James
5,397,510 A 3/1995 Clark
5,427,137 A 6/1995 Bowen
5,443,763 A 8/1995 Notar et al.
5,483,616 A 1/1996 Chiu et al.
5,485,866 A 1/1996 Bowen
RE35,153 E 2/1996 Chiu
5,490,957 A 2/1996 Lasko et al.
5,514,303 A 5/1996 Chiu et al.
5,527,157 A 6/1996 Collins et al.
5,529,726 A 6/1996 Glenn
5,547,615 A 8/1996 Jane et al.
5,573,713 A 11/1996 Tomasiak et al.
5,578,113 A 11/1996 Glenn
5,588,423 A 12/1996 Smith
5,610,591 A 3/1997 Gallagher
5,611,967 A 3/1997 Jane et al.
5,673,687 A * 10/1997 Dobson et al. ..... 128/204.14
5,688,446 A 11/1997 Glenn
5,759,451 A 6/1998 Tomasiak et al.
5,776,380 A 7/1998 Biagas, Jr.
5,783,117 A 7/1998 Byassec et al.
5,795,505 A 8/1998 Burns
5,800,741 A 9/1998 Glenn et al.
5,833,812 A 11/1998 Hartman
5,945,038 A 8/1999 Anderson
5,945,913 A 8/1999 Gallagher
5,967,380 A 10/1999 Litvin
6,000,684 A 12/1999 Pasch et al.
6,053,482 A 4/2000 Glenn et al.

* cited by examiner

EVAPORATIVE HUMIDIFIER

BACKGROUND OF THE INVENTION

1. Field of the Invention

The present invention relates generally to humidifiers and, more particularly, to evaporative humidifiers utilizing a wick filter. The present invention is further directed to an evaporative humidifier having a structure to facilitate the transporting and cleaning of components which contact water.

2. Description of the Related Art

Various types of humidifiers are utilized to provide moisture to indoor air and thereby modify relative humidity. Included among such humidifiers are ultrasonic humidifiers, steam humidifiers or vaporizers, and evaporative humidifiers.

Evaporative humidifiers typically include a housing having a reservoir of water and a stationary wick assembly supported within the housing. The reservoir is usually provided in fluid communication with a water tank for providing an extended supply of water. The lower end of the wick assembly is positioned within the reservoir to absorb water contained therein. Air is blown through the wick assembly, thereby causing evaporation of the water from the wick assembly and subsequent transfer of the evaporated water to the ambient air. If a stationary wick is utilized, the level of water within the reservoir should remain relatively constant to provide for both continuous absorption of water by the wick assembly and sufficient air flow therethrough. An example of such a conventional humidifier is disclosed in U.S. Pat. No. 5,110,511.

It is also known to provide a float assembly within the water reservoir for deactivating the humidifier when the water level within the water reservoir is deficient. A typical float assembly includes a float and a rod extending upwardly from the float. The float rod has traditionally been supported by a stationary retainer, fixed either to the inside of the humidifier housing or to a wick support frame. When the water level within the reservoir is sufficient, the upper end of the float rod closes an activation switch and the humidifier operates. As the water level falls, the float rod descends, until the rod no longer closes the activation switch, at which point the humidifier is deactivated. An example of such a prior art float assembly is disclosed in U.S. Pat. No. 5,945,038.

As may be appreciated, the tank, reservoir, and float assemblies of conventional evaporative humidifiers are often in prolonged contact with water. Furthermore, the traditional humidifier is designed for operation in a moist, warm environment. As such, these conditions tend to foster the growth of microorganisms which adhere to components which contact water and which may be unpleasant and potentially harmful to individuals in proximity to the operating humidifier.

In order to effectively clean traditional humidifiers, standard procedures include flushing the humidifier with a cleaning agent, such as chlorine bleach or a combination of vinegar and water, followed by a clean water flush. Unfortunately, such prior art cleaning procedures are often time consuming and therefore not routinely performed by the ordinary consumer.

As such, it may be appreciated that there remains a need for an evaporative humidifier having a simple design wherein the components which contact water may be easily disassembled and removed for cleaning. More particularly, there remains a need for such an evaporative humidifier which includes components which may be easily removed, disassembled and cleaned within a conventional dishwasher.

A further disadvantage of prior art evaporative humidifiers is with respect to difficulties in filling and transporting the water tank. Such tanks are often cumbersome and difficult to carry, particularly after they are filled with water. While improvements have been proposed with respect to handles for carrying such humidifier tanks, as in U.S. Pat. No. 5,483,616, there remains a need for a simple and effective design which facilitates the transporting of humidifier tanks.

SUMMARY OF THE INVENTION

The evaporative humidifier of the present invention includes a base having a bottom wall and a side support wall extending upwardly from the bottom wall. A water tray supporting recess is formed within the bottom wall of the base and removably supports a water tray. The base is substantially elliptical and defines a longitudinal major axis and a transverse minor axis. The water tray supporting recess of the base includes a footprint asymmetrical relative to the transverse minor axis. The water tray includes a bottom wall and a side wall extending upwardly therefrom. The water tray further includes a footprint substantially conforming to the footprint of the water tray supporting recess of the base.

A float assembly is supported by the water tray and includes a cover removably secured to the side wall of the water tray. A buoyant float is slidably received within the cover and includes an upper end vertically moveable relative to the bottom wall of the water tray.

A blower assembly is supported by the side wall of the base above the water tray and includes a housing, a motor supported within the housing, and a fan supported within the housing and operably connected to the motor. A float switch is selectively engagable with the upper end of the buoyant float for selectively deactivating the motor. The housing includes an air inlet, an air outlet, and an evaporative air flow path extending between the air inlet and the air outlet.

A self-standing wick assembly is supported by the bottom wall of the water tray and extends upwardly into the air flow path within the housing. The wick assembly includes a wick filter having a cylindrical side wall, an open lower end, and an open upper end, wherein the lower end is in absorbing contact with water supported in the water tray. A cylindrical wick assembly locator extends upwardly from the bottom wall of the water tray, and the lower end of the wick filter is concentrically received over the wick assembly locator.

A tank is removably supported by the side wall of the base above the water tray and adjacent the blower assembly. The tank includes a concave side wall, a convex side wall, a bottom wall and a top wall. The concave side wall is concaved inwardly to provide clearance for the leg of a user carrying the tank. A valve is concentrically positioned relative to an aperture formed in the bottom wall of the tank. A valve actuator extends upwardly from the bottom wall of the water tray and is engagable with the valve for providing fluid communication between an interior chamber of the tank and the water tray. The valve is supported within a cap which selectively seals the aperture of the bottom wall of the tank. The aperture within the bottom wall of the tank is sized to have a diameter large enough, preferably at least as great as approximately 3.5 inches, to permit the hand of a user access to the interior chamber of the tank.

A handle is supported by the top wall of the tank and includes a support portion positioned opposite a center axis of the tank from the concave side wall wherein the handle defines a pivot point. As such, supporting the tank from the handle causes the concave side wall to swing about the handle in a direction upwardly and toward the convex side wall, thereby providing additional clearance for movement of the leg of the user holding the tank. A recess is formed within the top wall of the tank proximate the convex side wall. An upper portion of the handle is supported above the recess and is substantially flush with the top wall of the tank.

The water tray, float assembly and tank are formed of a dishwasher safe thermoplastic material. Additionally, the water tray, float assembly and tank are a first color, wherein the base, which is not formed entirely of a dishwasher safe thermoplastic material, is a second color visibly distinguishable from the first color. As such, the dishwashable components of the first color are easily identifiable.

Therefore, it is an object of the present invention to provide an evaporative humidifier having components in contact with water which may be easily removed and disassembled to facilitate cleaning.

It is another object of the present invention to provide such an evaporative humidifier having a water tray, float assembly, and tank which may be easily removed and disassembled from each other and from a base, blower assembly and wick assembly.

It is a further object of the present invention to provide such an evaporative humidifier having a water tray, float assembly, and tank which may be cleaned within a conventional dishwasher.

It is yet another object of the present invention to provide an evaporative humidifier having a base with an asymmetrical water tray supporting recess to facilitate proper seating of a water tray therein.

It is a further object of the present invention to provide a water tray having a wick assembly locator to facilitate proper positioning of a wick assembly thereon.

It is still yet another object of the present invention to provide such a water tray having a handle extending upwardly from the wick assembly locator to facilitate removal of the water tray from the base.

It is a further object of the present invention to provide a humidifier including a tank having a structure facilitating its transportation.

It is another object of the present invention to provide such a tank including a concave side wall which provides clearance for the leg of a user carrying the tank.

It is further object of the present invention to provide such a tank including a handle defining a pivot point for swinging the concave side wall upwardly and outwardly away from the leg of a user carrying the tank.

Other objects and advantages of the invention will be apparent from the following description, the accompanying drawings and the appended claims.

DETAILED DESCRIPTION OF THE PREFERRED EMBODIMENT

Figure 5:
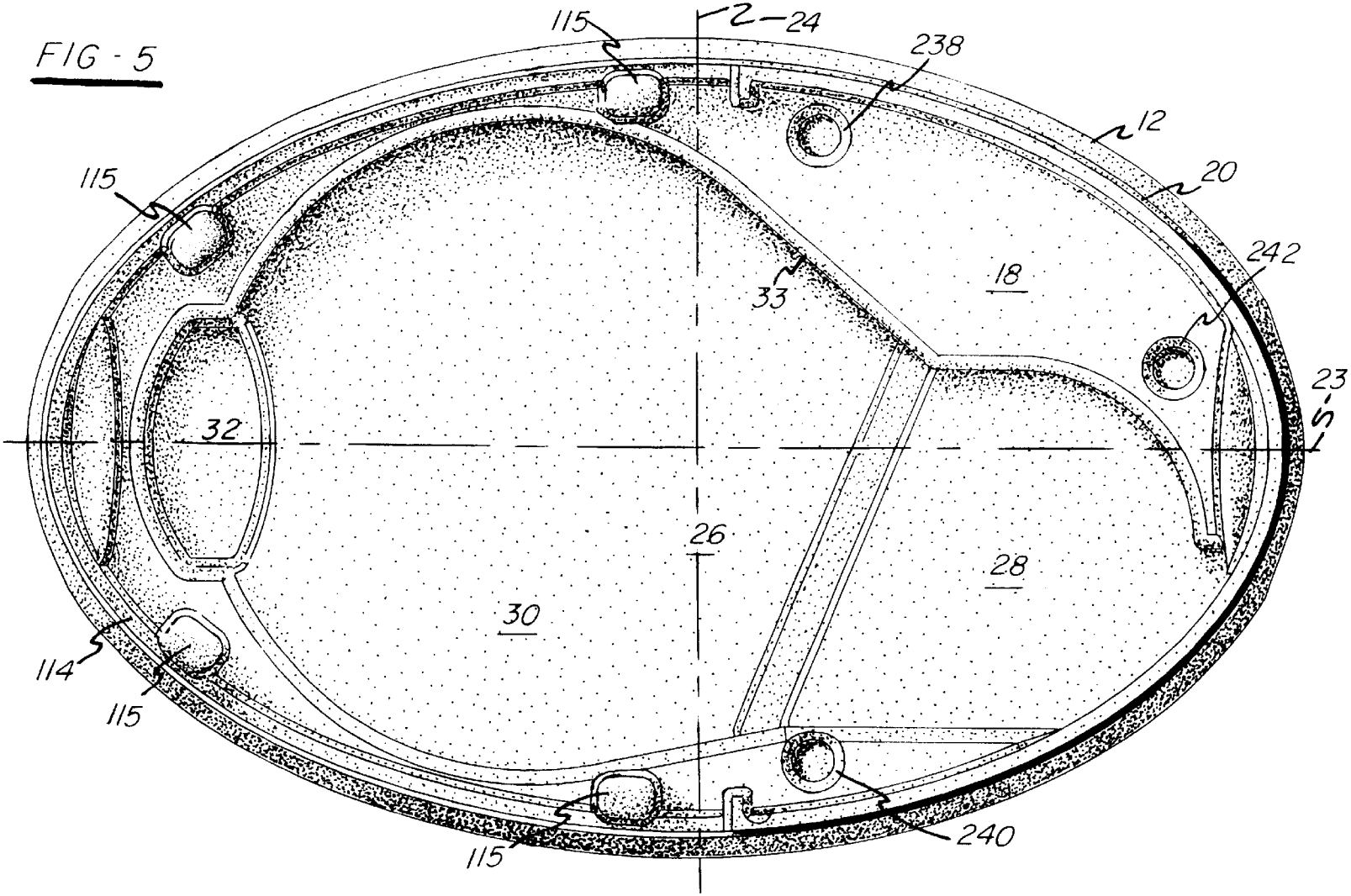
FIG. 5 is a top plan view of the base.

Referring initially to FIGS. 1–5, an evaporative humidifier 10 embodying the invention is illustrated as including a base 12 removably supporting a humidification unit or blower assembly 14 and a water tank 16. The base 12 includes a bottom wall 18 supported by a plurality of legs 19, and a side support wall 20 extending upwardly from a periphery of the bottom wall 18. A pair of opposing recessed handles 21 and 22 are preferably formed within the lower end of the side support wall 20 to facilitate handling of the humidifier 10. As illustrated in FIG. 5, the base 12 is substantially elliptical and includes a longitudinal major axis 23 and a transverse minor axis 24.

Figure 2:
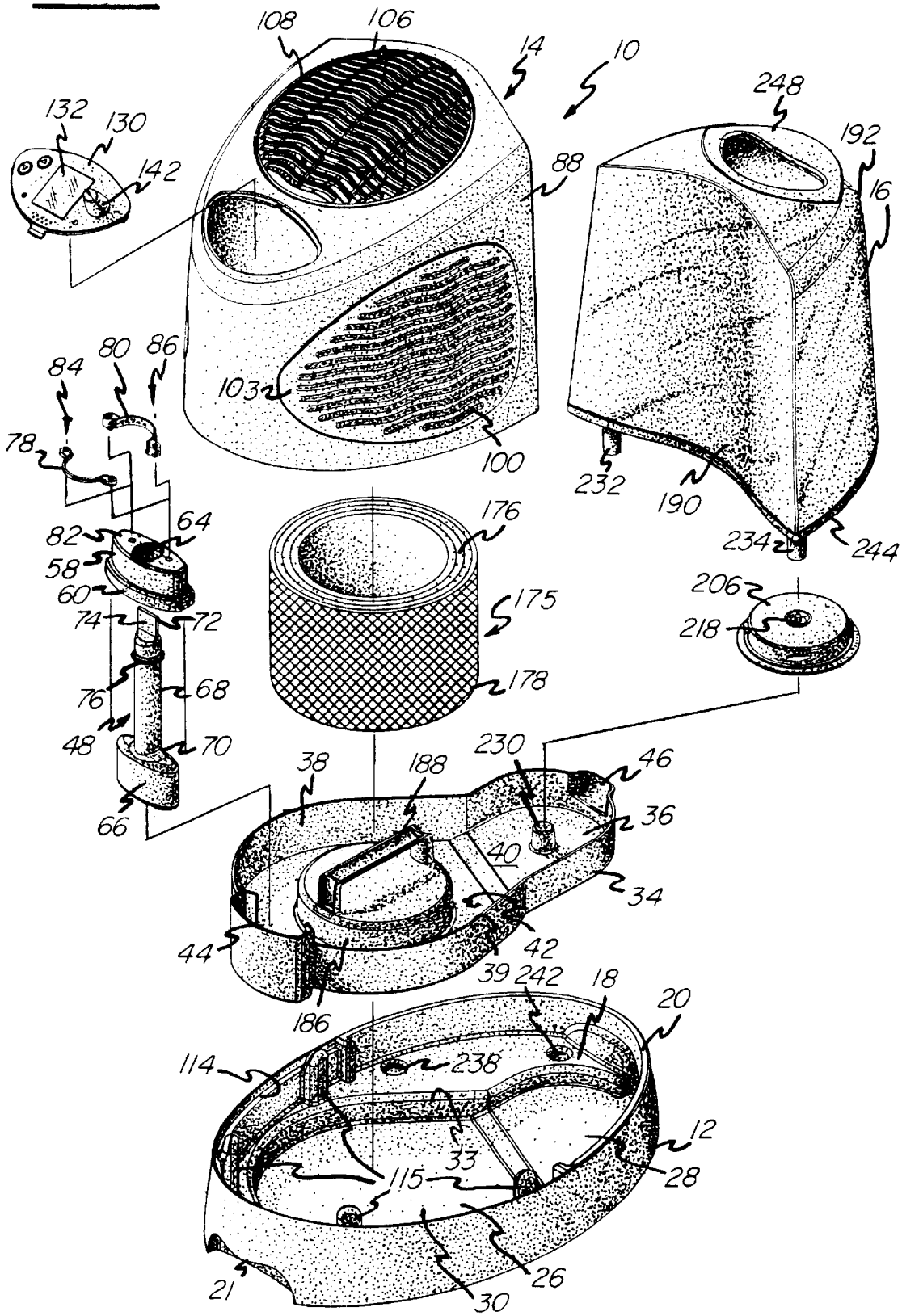
FIG. 2 is an exploded perspective view of the evaporative humidifier of the present invention.
Figure 3:
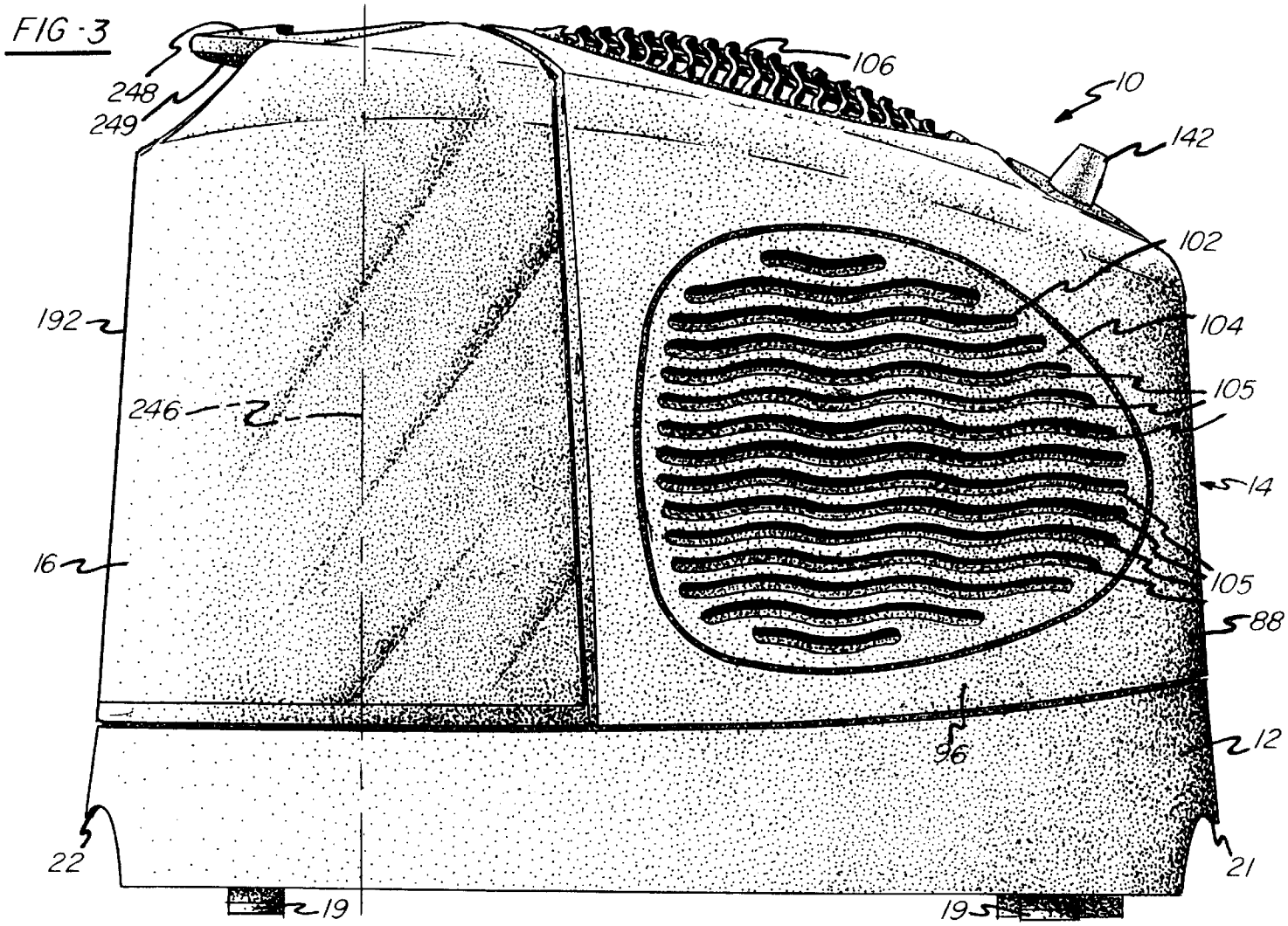
FIG. 3 is a left side elevational view of the evaporative humidifier of the present invention.
Figure 4:
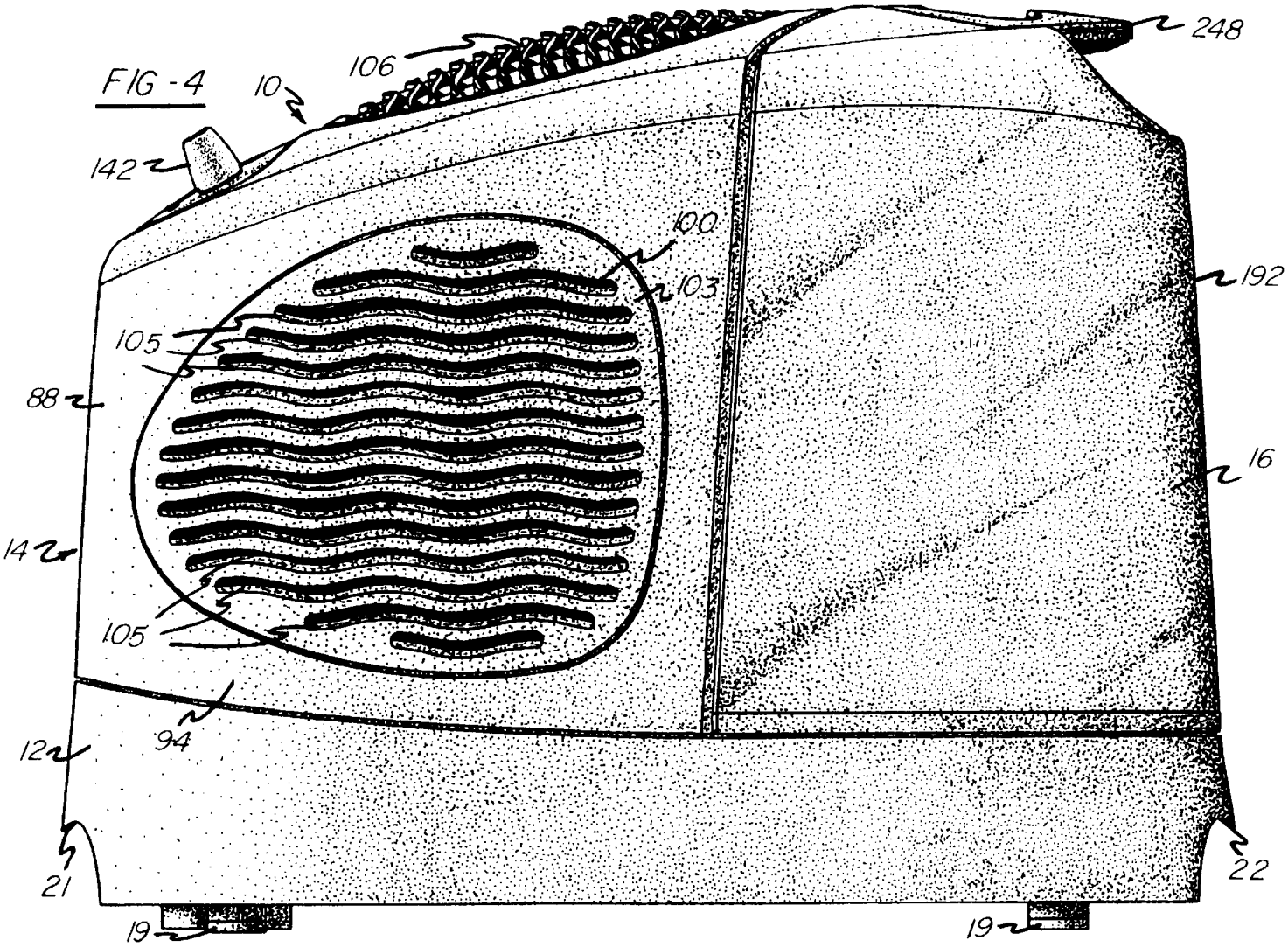
FIG. 4 is a right side elevational view of the evaporative humidifier of the present invention.
Figure 9:
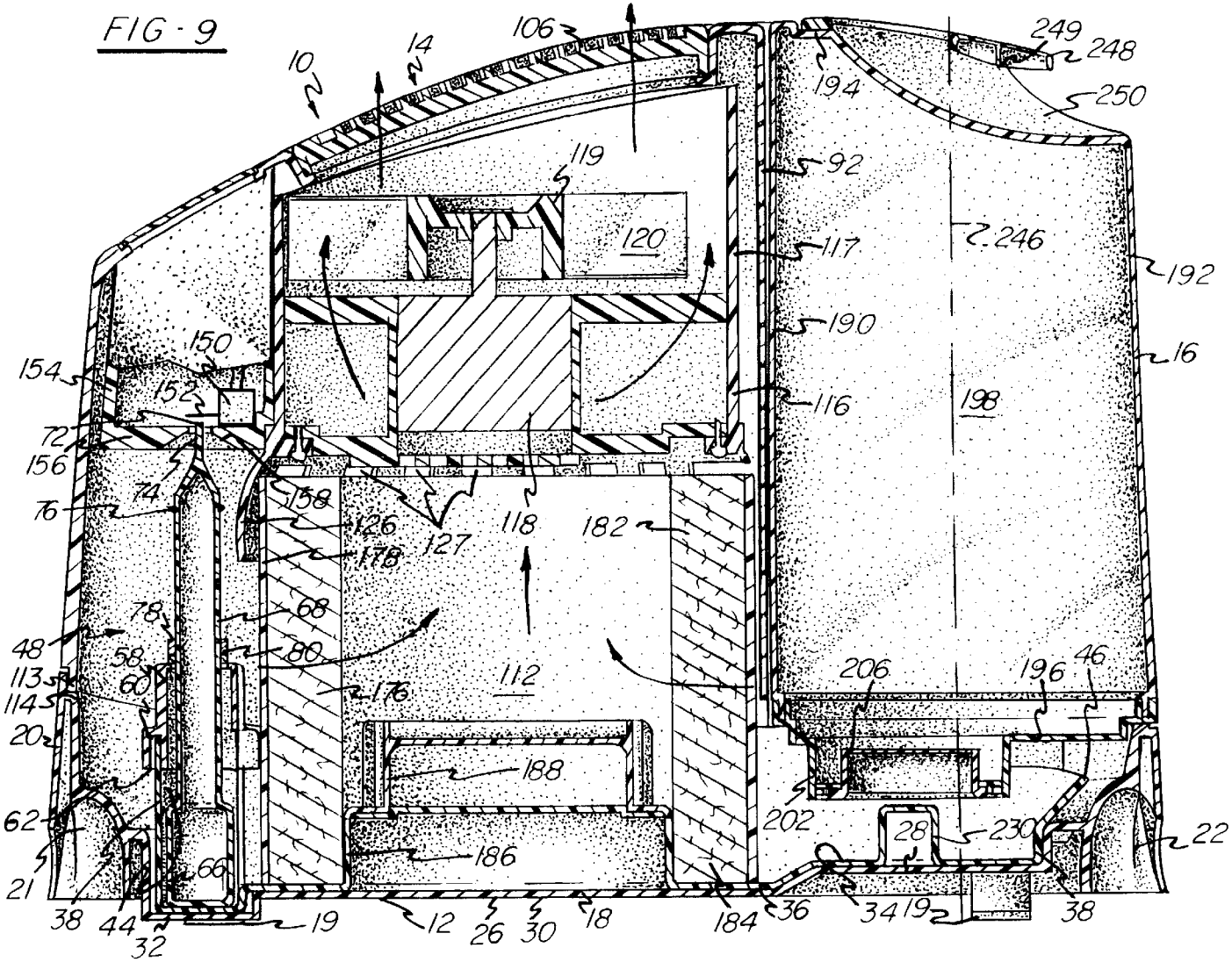
FIG. 9 is a partial cross-sectional view taken along line 9—9 of FIG. 1.

Referring now to FIGS. 2, 5 and 9, a water tray supporting recess 26 projects downwardly within the bottom wall 18. The water tray supporting recess 26 includes interconnected first, second and third sections 28, 30 and 32, and a footprint 33 which is asymmetrical relative to the transverse minor axis 24 (FIG. 5). Moreover, the footprint of the first section 28 differs substantially from the footprint of the second and third sections 30 and 32. Additionally, the first section 28 is positioned above the second section 30, which, in turn, is positioned above the third section 32, thereby providing a downward gradient from the first section 28 to the second and third sections 30 and 32.

A water tray 34 is removably supported within the water tray supporting recess 26 of the base 12 and is adapted for receiving and holding a supply of water. The water tray 34 includes a bottom wall 36 and a side wall 38 extending upwardly from the periphery of the bottom wall 36. The footprint 39 of the water tray 34 substantially conforms to the footprint 33 of the water tray supporting recess 26 of the base 12. Moreover, the footprint 39 of the water tray 34 is received in substantially parallel relation within the footprint 33 of the bottom wall 36.

The water tray 34 further includes a water receiving portion 40 in fluid communication with an evaporative portion 42. A float reservoir 44 is provided in fluid communication with the evaporative portion 42. The water receiving portion 40, evaporate portion 42 and float reservoir 44 are received within the first section 28, second section 30, and third section 32, respectively, of the water tray supporting recess 26. Given the asymmetrical structure of the water tray supporting recess 26 and the water tray 34, it may be appreciated that the water tray 34 is properly receivable within the water tray supporting recess 26 in only one position.

The bottom wall 36 within the evaporative portion 42 is positioned below the bottom wall 36 within the water receiving portion 40. Additionally, the bottom wall 36 within the float reservoir 44 is positioned below the bottom wall 46 within the evaporative portion 42. As such, water within the water tray 34 tends to travel in a direction from the water receiving portion 40 to the float reservoir 44. A portion of the side wall 38 opposite the float reservoir 44 includes an inclined portion or spout 46 to facilitate pouring of water from the tray 34.

Figure 1:
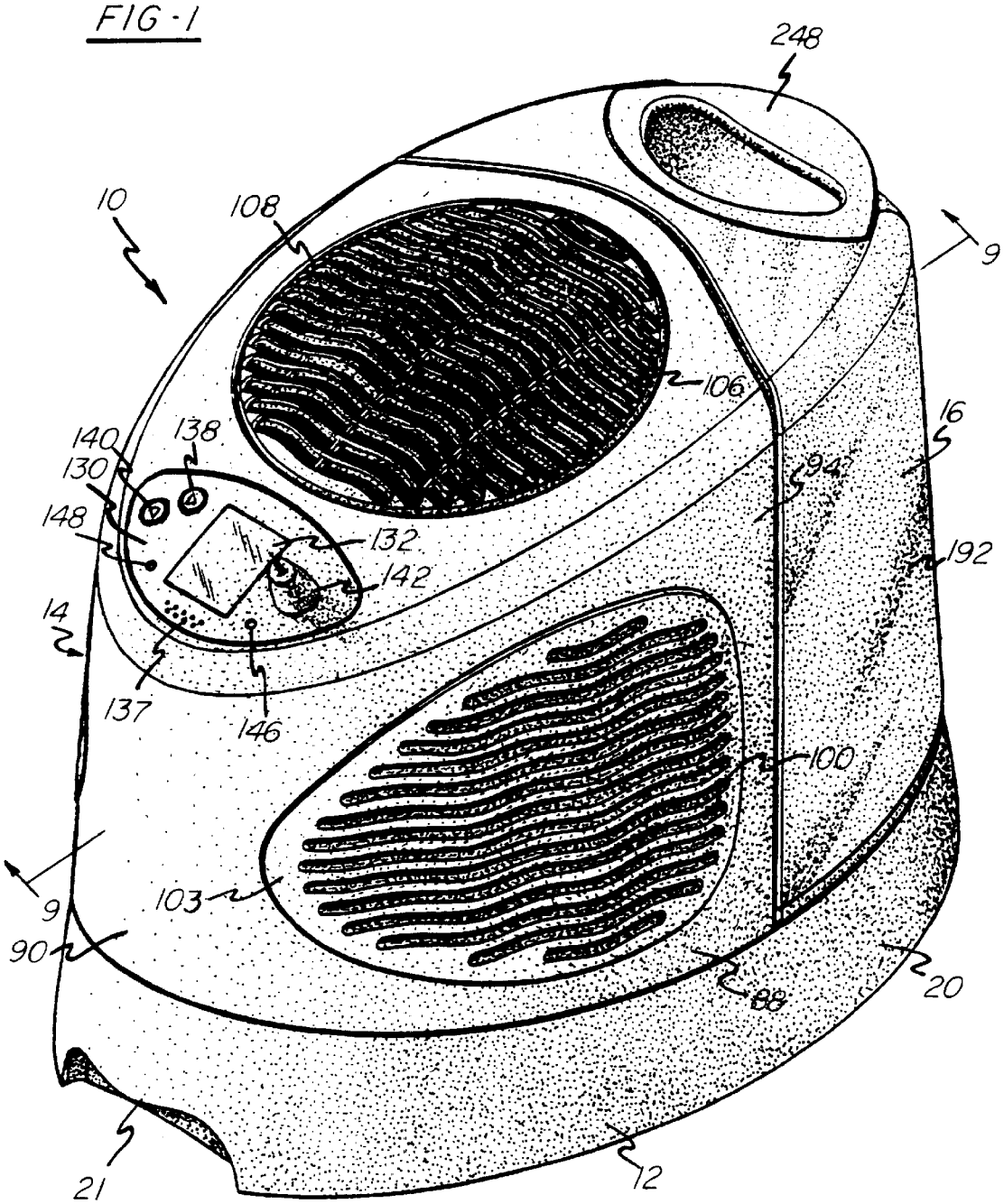
FIG. 1 is a perspective view as seen from the top, front and right side of an evaporative humidifier that embodies the present invention.

Turning now to FIGS. 1, 2 and 9, the float assembly 48 is removably supported by the water tray 34 and includes a cover 58 releasably secured to the side wall 38. Moreover, the cover 58 includes a base 60 defining a slot 62 for frictionally engaging a portion of the side wall 38. The cover 58 further includes a centrally positioned aperture 64 for slidably receiving and guiding a buoyant float 66 including an vertically extending switch actuator 68. The buoyant float 66 is supported within the float reservoir 44. In the preferred embodiment, the vertically extending switch actuator 68 is formed as an integral part of the buoyant float 66. Regardless of the construction, at least the buoyant float 66 is made of a buoyant material. As may be readily appreciated, the buoyant float 66 and the vertically extending switch actuator 68 are vertically moveable relative to the bottom wall 36 of the water tray 34 in response to changing levels of water within the float reservoir 44.

A lower end 70 of the vertically extending switch actuator 68 is supported by the buoyant float 66, while the upper end 72 of the vertically extending switch actuator 68 includes a tapered switch engaging blade 74. A retaining ring 76 is supported proximate the upper end 72 of the vertically extending switch actuator 68 and is engagable with a pair of retaining clips 78 and 80 fixed to an upper surface 82 of the cover 58 proximate the aperture 64. The retaining clip 78 and 80 are preferably secured using traditional fasteners, such as screws 84 and 86, although other fastening means may be readily substituted therefore. It should be appreciated that the interaction between the retaining ring 76 and the retaining clips 78 and 80 maintains the cover 58, buoyant float 66 and vertically extending switch actuator 68 together as a single float assembly 48, while providing limited relative movement between the cover 58 and the vertically extending switch actuator 68.

Referring now to FIGS. 1–4, 6 and 10, the blower assembly 14 comprises a housing 88 including arcuate front and rear walls 90 and 92 interconnecting opposing first and second side walls 94 and 96, and further defining an open bottom 97. A top wall 98 interconnects the front and rear walls 90 and 92 along with the first and second side walls 94 and 96. First and second air inlets 100 and 102 are formed within the first and second side walls 94 and 96 and preferably include inlet grilles 103 and 104 having a plurality of substantially horizontally extending slots 105 extending therethrough. Likewise, an air exhaust outlet 106 is formed within the top wall 98 and includes a grille 108 defining a plurality of slots 110. The air inlets 100 and 102 and air exhaust outlet 106 provide communication to an evaporative air flow path 112 (FIG. 9).

The blower assembly 14 is removably supported by the base 12 above the water tray 34. More particularly, a recessed flange 113 extends around the lower peripheral edge of the housing 88 for supporting the housing 88 by a lip 114 formed in the side support wall 20 of the base 12. A plurality of positioning tabs 115 extend upwardly from the bottom wall 18 of the base 12 and adjacent the side support wall 20 for securely positioning the housing 88.

Figure 6:
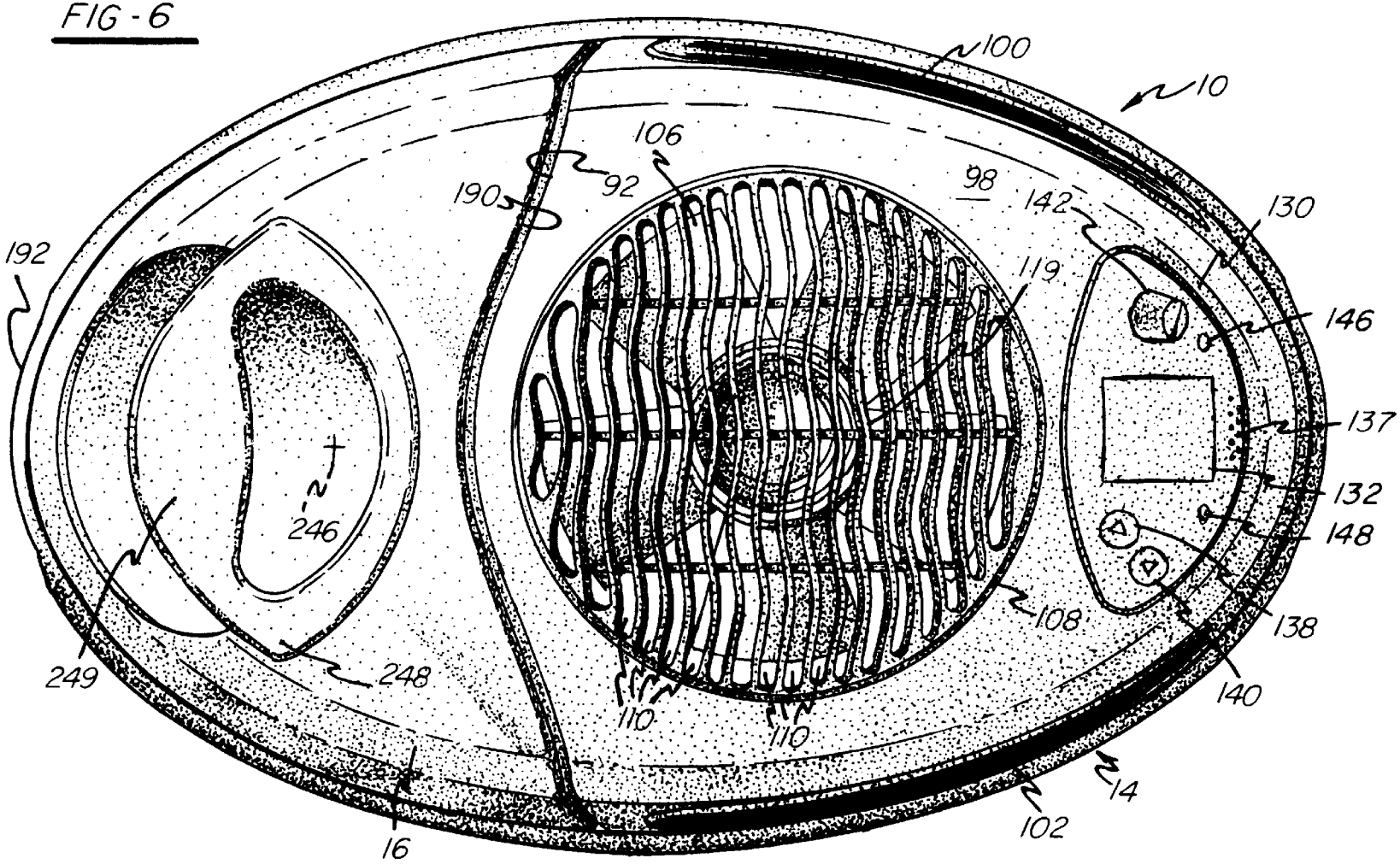
FIG. 6 is a top plan view of the evaporative humidifier of the present invention.
Figure 7:
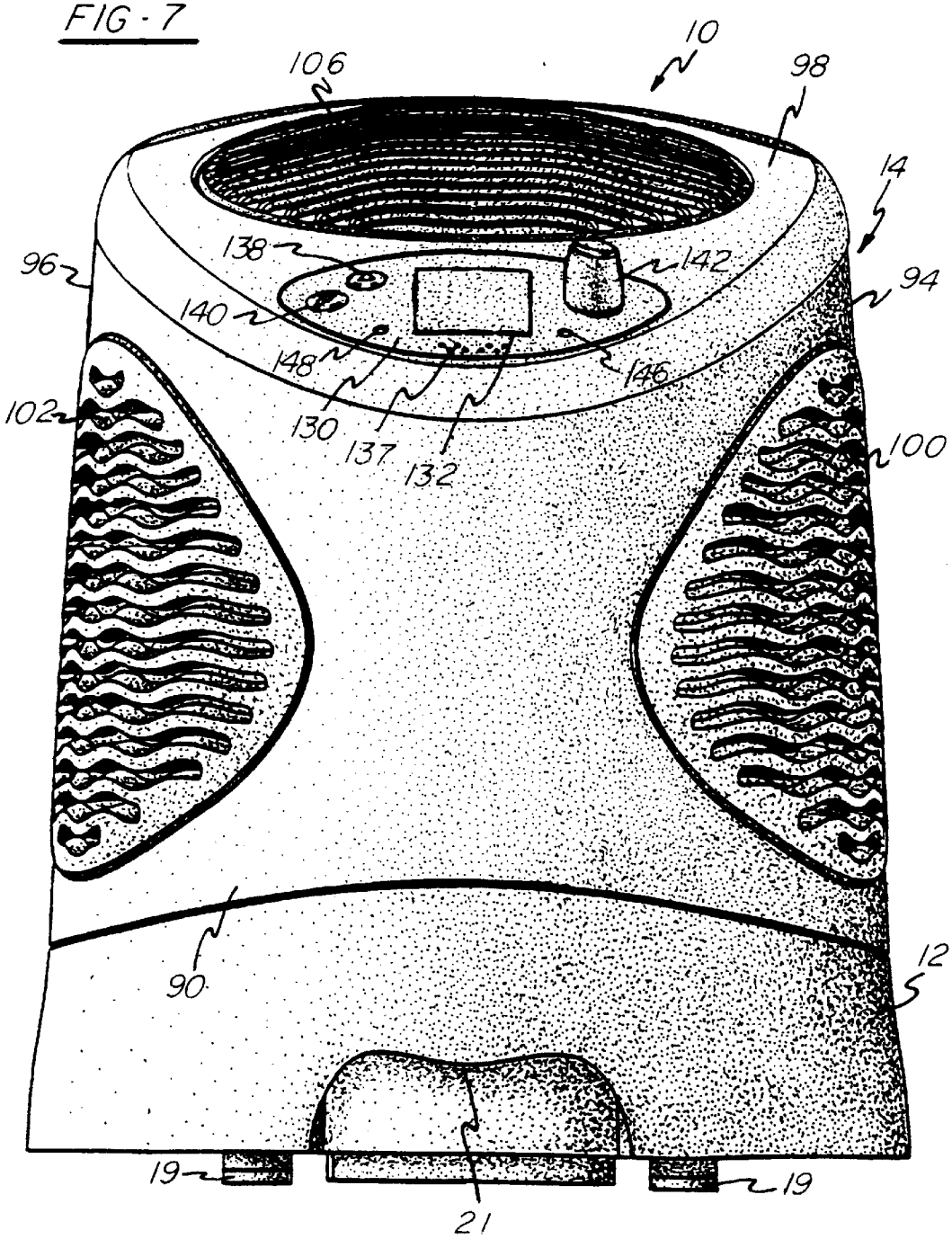
FIG. 7 is a front side elevational view of the evaporative humidifier of the present invention.

Referring to FIGS. 6. 9 and 10, a fan enclosure 116 is supported within the housing 88 and includes a cylindrical wall 117 extending downwardly from the top wall 98. A conventional motor 118 is supported by the cylindrical wall 117 and is operably connected to a fan 119. The fan 119 includes a plurality of blades 120 for propelling air upwardly from the open bottom 97 of the housing 88 and out through the air exhaust outlet 106. A guard 122 is fixed to a lower surface of the fan enclosure 116 and includes a safety grille 124 for preventing accidental contact with the motor 118 and the fan blades 120. Additionally, the guard 122 supports an arcuate receiving shield 126 including a plurality of air flow passages 127 extending concentrically downwardly from the cylindrical wall 117.

Figure 11:
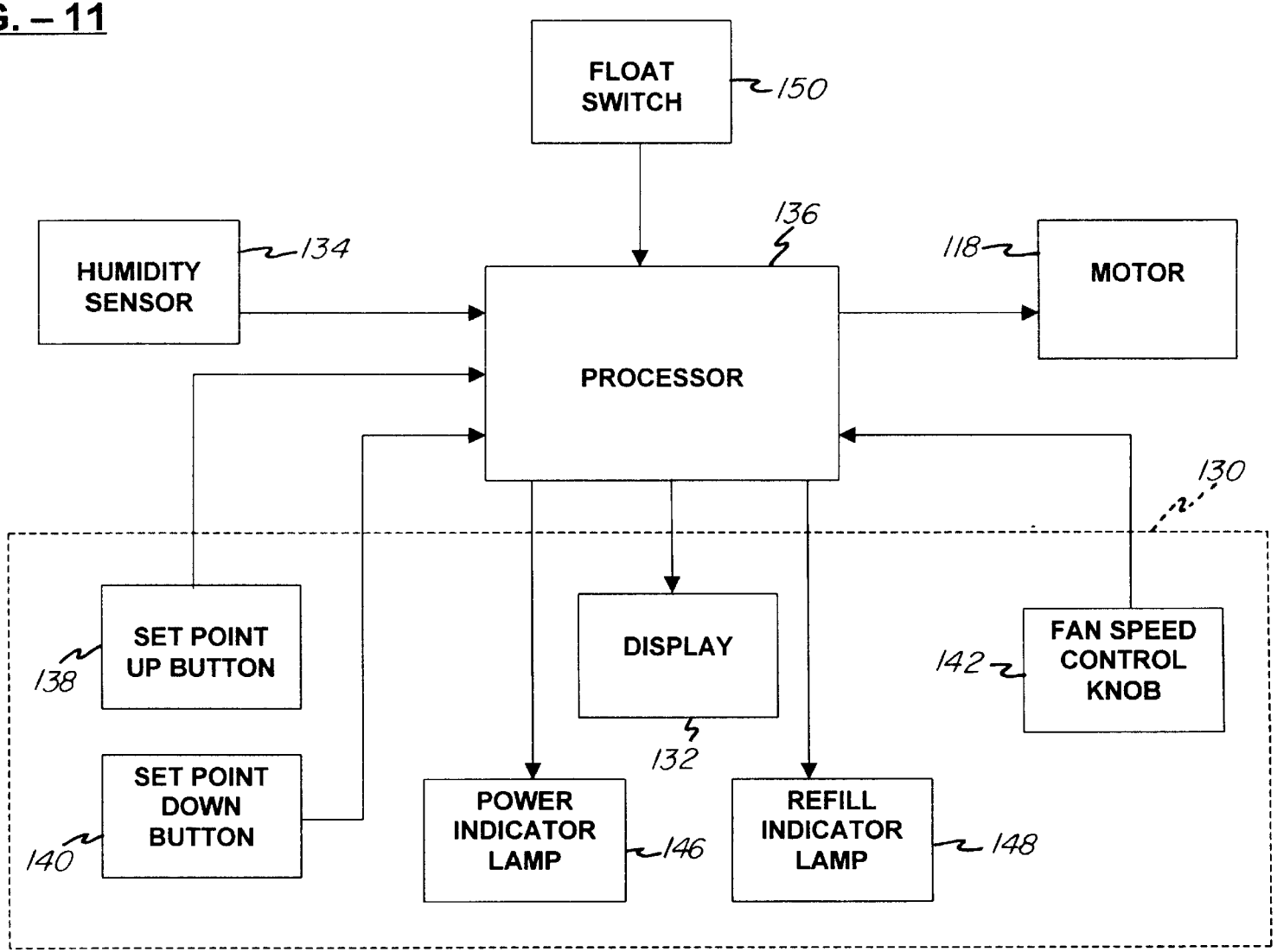
FIG. 11 is a block diagram illustrating the interconnection between various electrical components in a preferred embodiment of the evaporative humidifier of the present invention.
Figure 12:
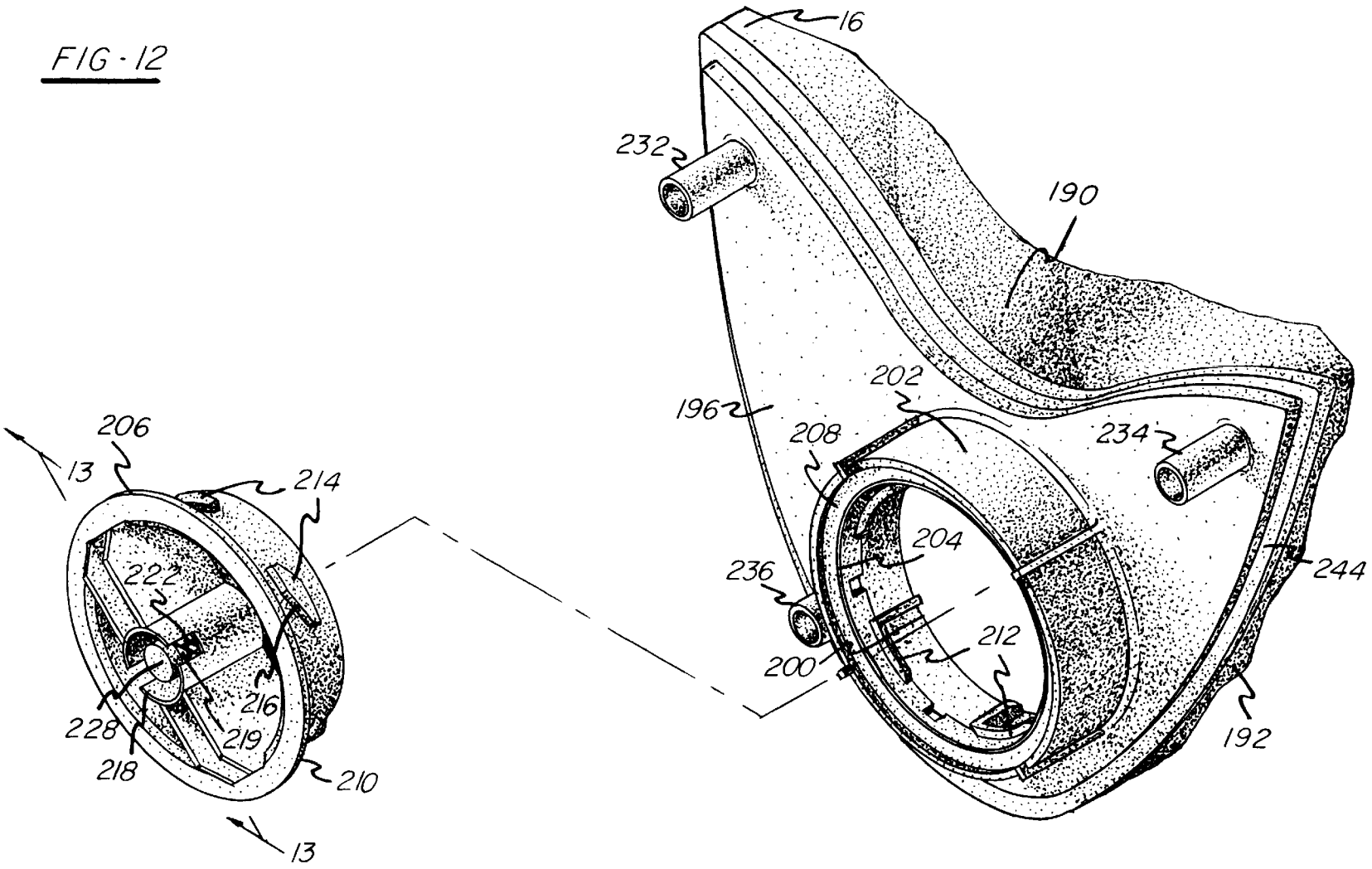
FIG. 12 is a partial exploded perspective view as seen from the bottom of the tank.
Figure 13:
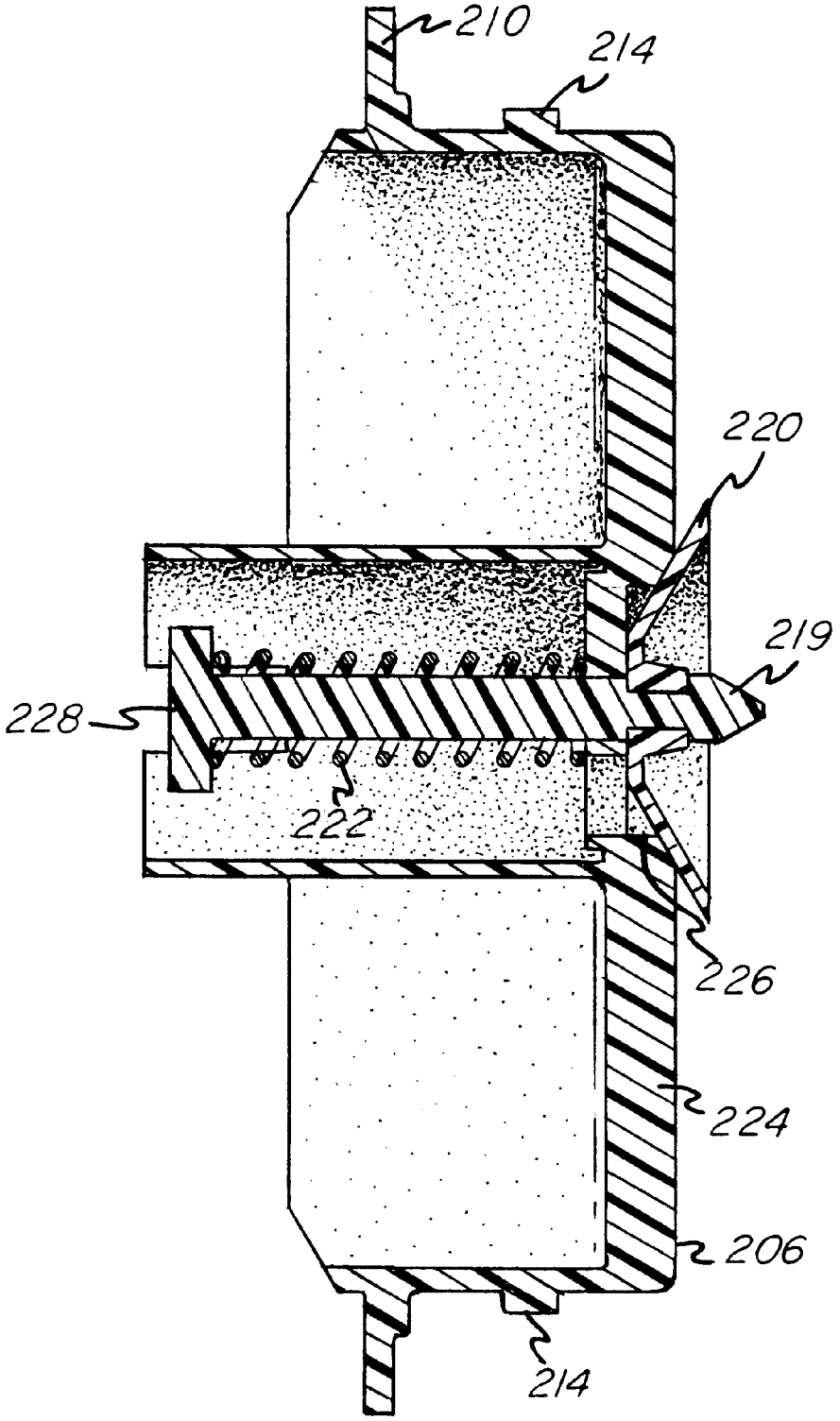
FIG. 13 is a cross-sectional view taken along line 13—13 of FIG. 12.

Referring now to FIGS. 1, 6 and 11, a control panel 130 is supported by the top wall 98 of the housing 88 intermediate the front wall 90 and the air exhaust outlet 106. The control panel 130 includes a display 132, preferably a liquid crystal display, for providing an indication of the relative humidity of ambient air received from a humidity sensor 134 communicating with a processor 136. An inlet 137 is provided in the control panel 130 to provide fluid communication between the humidity sensor 134 and ambient air. The display 132 further provides an indication of a set or desired relative humidity which may be programmed by a user through desired humidity set point up and down set point buttons 138 and 140. A rotatable fan speed control knob 142 is provided to control operation of the fan 119 by varying the desired speed of the motor 118.

The humidity sensor 134 is of conventional design and senses ambient air relative humidity through the inlet 137 formed within the control panel 130. The humidity sensor 134 is in a continuous active condition and sends signals to the processor 136 whenever the processor 136 is energized. Additionally, a power indicator lamp 146 and a refill indicator lamp 148 are supported within the control panel 130 and controlled by the processor 136. More particularly, the power indicator lamp 146 illuminates when the motor 118 is activated. Likewise, the refill indicator lamp 148 illuminates when an activation or float switch 150 is in an open state as described below.

Figure 10:
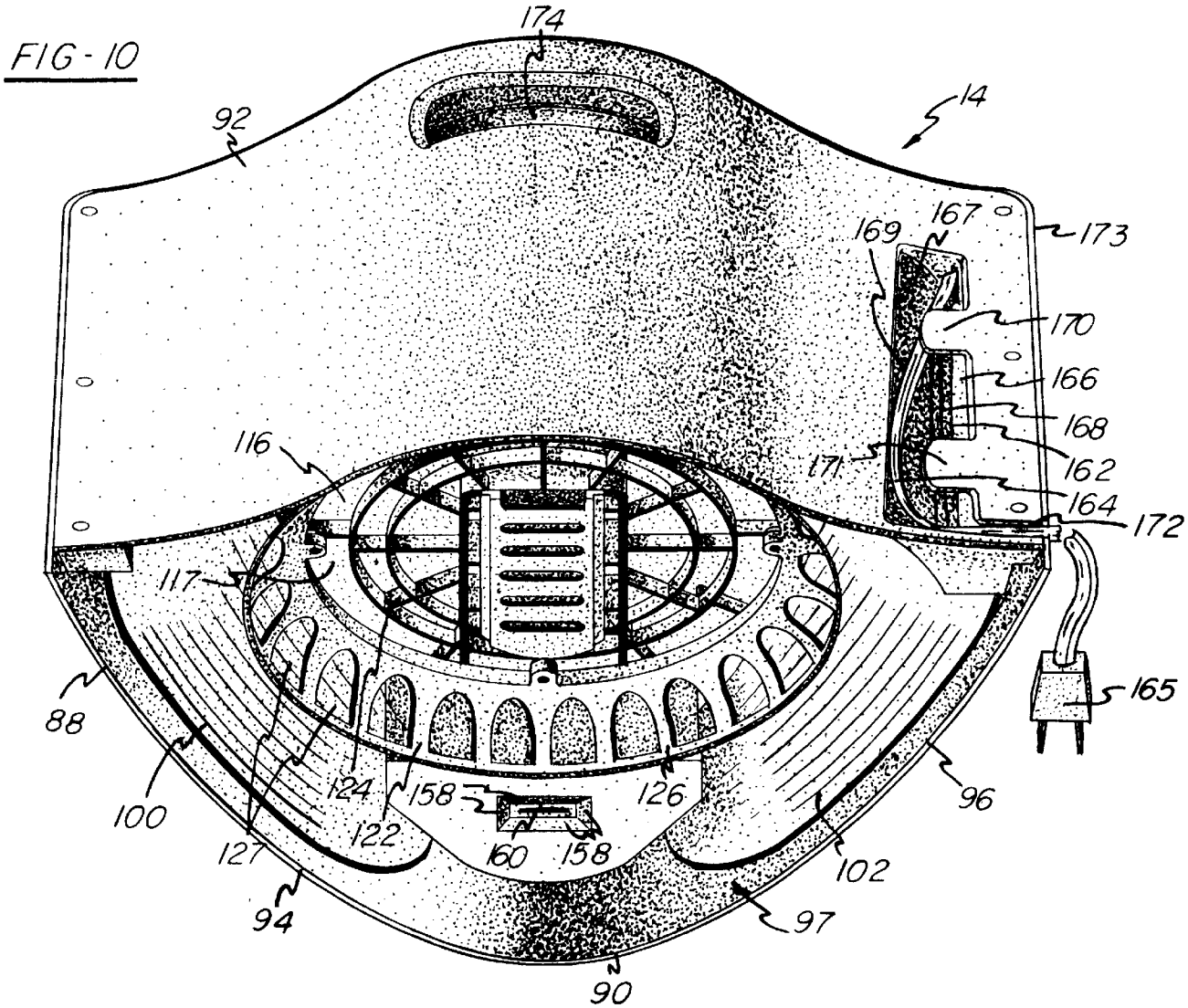
FIG. 10 is a perspective view as seen from the bottom and rear of the blower assembly.

Referring further to FIGS. 9 and 10, the housing 88 of the blower assembly 14 supports the float switch 150 which communicates with the processor 136 for either allowing or preventing the supply of power to the motor 118. The float switch 150 is of conventional design and preferably includes a spring biased lever arm 152 that creates an electrical contact when depressed and breaks the contact when not depressed. Consequently, when the lever arm 152 is depressed, the float switch 150 sends a signal to the processor 136 for activating the motor 118. Likewise, when the lever arm 152 is not depressed, the float switch 150 sends a signal to the processor 136 for deactivating the motor 118. The float switch 150 is supported within a control housing 154 adjacent to the fan enclosure 115. The control housing 154 includes a bottom wall 156 including tapered converging surfaces 158 leading to a slot 160. The lever arm 152 is positioned inside the control housing 154 adjacent the slot 160.

The switch engaging blade 74 of the upper end 72 of the vertically extending switch actuator 68 is selectively engagable with the lever arm 152 through the slot 160. The control housing 154 also contains the processor 136 which, as indicated above, is in electrical communication with the humidity sensor 134, set point buttons 138 and 140, control knob 142, power indicator lamp 146 and refill indicator lamp 148.

Figure 8:
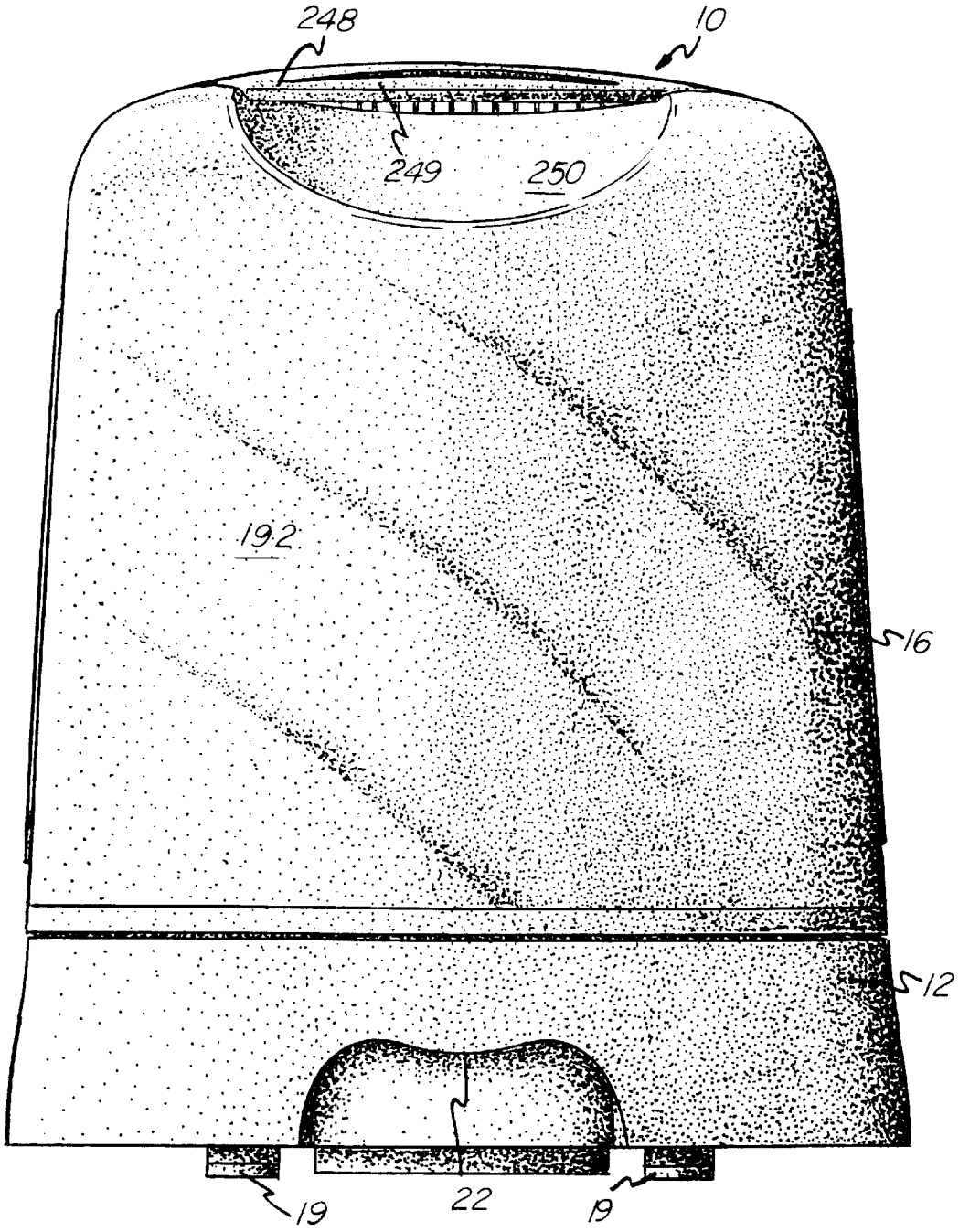
FIG. 8 is a rear side elevational view of the evaporative humidifier of the present invention.

Referring now to FIGS. 8 and 10, the rear wall 92 of the housing 88 includes a cord storage compartment 162 for receiving an excess amount of electrical cord 164. The electrical cord 164 is of conventional design and includes a plug 165 for providing electrical power to the motor 116. The storage compartment 162 extends inwardly from the rear wall 92 and includes first and second vertically extending side walls 166 and 167 interconnected by an intermediate wall 168. The second side wall 167 includes an arcuate portion 169 defined by an outer surface of the cylindrical wall 117 of the fan enclosure 116. First and second retaining tabs 170 and 171 are provided for securing the excess cord 164 within the compartment 162. A passageway 172 is provided within the rear wall 92 and provides communication between the storage compartment 162 and an outer surface 173 of the housing 88. A recessed handle 174 is also provided in the rear wall 92 of the housing 88 to facilitate handling of the blower assembly 14 by a user. As may be appreciated by viewing FIGS. 8 and 10, the excess cord 164 is hidden from view by the water tank 16 when the humidifier 10 is in its normal operating condition with the blower assembly 14 positioned adjacent the tank 16 on the base 12.

Turning now to FIGS. 2 and 9, a wick assembly 175 is supported by the bottom wall 36 of the water tray 34. The wick assembly 175 includes a wick filter 176 and a permeable support 178 which permits the wick assembly 175 to be self-standing. The wick filter 176 is preferably cylindrical in shape and includes a side wall 180, an open top 182 and an open bottom 184. The wick assembly 175 is preferably concentrically received over a cylindrical wick assembly locator 186 supported by and extending upwardly from the bottom wall 36 of the water tray 34. As such, the bottom 184 of the wick filter 176 is in contact with water supported by the bottom wall 36 of the water tray 34. The wick assembly 175 extends upwardly into the air flow path 112 defined by the housing 88 of the blower assembly 14. The top 182 of the wick assembly 175 is received within and appropriately aligned with the fan 118 by the receiving shield 126. A carrying handle 188 extends upwardly from the wick assembly locator 186 to facilitate removal and transportation of the water tray 34.

The preferred permeable support 178 extends around the outer cylindrical side wall 180 of the wick filter 176. The permeable support 178 is preferably comprised of expanded mesh of solid material, preferably a resin coated cotton/cellulose material. The wick filter 176 preferably consists of an expanded cotton/cellulose material, such as that manufactured by Columbus Industries. More particularly, the wick assembly 175 may have a structure similar to the that disclosed in U.S. Pat. No. 5,800,741, which is incorporated herein by reference.

Referring now to FIGS. 1–4, 6, 8 and 12–13, the water tank 16 includes a concave first side wall 190, a convex second side wall 192, a top wall 194 and a bottom wall 196, thereby defining an interior chamber 198. The concave side wall 190 is curved in a direction toward the convex side wall 192, while the convex side wall 192 is curved in a direction away from the concave side wall 190. An aperture 200 is formed within the bottom wall 196 of the tank 16. A tubular projection 202, including an annular flange 204, extends downwardly from the bottom wall 196 and is concentrically disposed around the aperture 200. The aperture 200 is sized to have a diameter large enough to provide adequate access by the hand of a user to the interior chamber 198. In the preferred embodiment, the diameter of the aperture is at least as great as approximately 3.5 inches and is selected based upon ergonomic considerations for permitting a large percentage of users access with a hand to the interior chamber 198 of the tank 16. It may be further appreciated that the large aperture 200 further facilitates filling of the tank 16.

A cap 206 is removably and sealingly supported by tubular projection 202. A gasket 208 is received within the annular flange 204 for sealingly engaging a lip 210 supported by the cap 206. A plurality of radially inwardly extending first locking tabs 212 are supported by the tubular projection 202. A plurality of cooperating second locking tabs 214, having inclined ramp surfaces 216, extend radially outwardly from a side wall 217 of the cap 206. The inclined ramp surfaces 216 formed on the cap 206 force the lip 210 into sealing and locking engagement with the flange 204 through the gasket 208 as the cap 202 is rotated by approximately 90 degrees.

The cap 206 concentrically supports a valve 218 including a plunger 219, a valve seal 220, and a compression spring 222. The cap 206 further comprises a horizontal circular bottom wall 224 and a discharge opening 226 formed therein. The valve plunger 219 is loosely received through the discharge opening 226 to allow for axial movement of the plunger 219 relative to the cap 206. The valve seal 220 is attached to an upper end of the plunger 219. The spring 222 is compressed between the cap 206 and a disc 228 supported on the lower end of the plunger 210 to bias the seal 220 toward the discharge opening 226. The tubular projection 202 preferably extends below the disc 228 for preventing accidental opening of the valve 218 of the tank 16 should the bottom wall 196 be supported on a flat surface.

A valve actuator 230, preferably in the form of a cylindrical protrusion, extends upwardly from the bottom wall 36 of the water tray 34 and is aligned with the disc 228 of the valve 218. As such, when the water tank 16 is positioned on the side wall 70 of the base 12, above the water tray 34, the protrusion 230 forces the valve 218 into an open position by forcing the seal 220 away from the opening 226 and thereby allowing water to flow from the interior chamber 198 into the water receiving portion 40 of the water tray 34.

A plurality of cylindrical locating pegs 232, 234 and 236 extend downwardly from the bottom wall 196 of the tank 16 and are receivable within cylindrical recesses 238, 240 and 242 extending downwardly within the bottom wall 18 of the base 12 for properly positioning the tank 16. A recessed flange 244 extends around the periphery of the bottom wall 196 proximate the convex side wall 192 and engages the side wall 20 of the base 12 for locating and supporting the tank 16.

A vertically extending center axis 246 passes through the center of gravity of the tank 16. A handle 248, including a support portion 249, is positioned above a recess 250 formed within the top wall 194 of the tank 16. The top wall 194 of the tank 16 is substantially flush with the support portion 249 thereby defining a substantially planar surface allowing the tank 16 to be supported in an inverted position by the top wall 194.

The support portion 249 of the handle is supported on the side of the center axis 246 proximate the convex side wall 192 wherein the handle 248 defines a pivot point. The support portion 249 is adapted to be grasped by the user transporting the tank 16. By positioning the support portion 249 of the handle 248 on the side of the axis 246 opposite the concave side wall 190, supporting the tank 16 by the handle 248 causes the concave side wall 190 to swing or pivot about the handle 248 in a direction upwardly and toward the convex side wall 192. It may be readily appreciated that the concave side wall 190 provides clearance for the leg of a user carrying the tank 16, while the positioning of the handle 248 facilitates movement of the concave side wall 190 away from the leg of the user.

In the preferred embodiment of the humidifier 10 of the present invention, the water tray 34, float assembly 48, water tank 16 and cap 206 are each made of a dishwasher safe material, such as molded thermoplastic. In the most preferred embodiment, these components are each molded from a polycarbonate material which is then annealed to substantially remove residual stresses resulting from the molding process. Further, the water tray 34, float assembly 48, water tank 16 and cap 206 are preferably made a first color, such as transparent smoke. The housing 88 of the blower assembly 14 and the base 12, which are not entirely composed of dishwasher safe materials, are made a second color, such as opaque ivory, which is visibly distinguishable from the first color. As such, the user may easily identify those components which are dishwashable.

Next, the operation of the humidifier 10 will be described in greater detail. Prior to initiating operation of the humidifier 10, the wick assembly 175 is inspected and replaced, if necessary. Installing a new wick assembly 175 involves simply removing the blower assembly 14 from the base 12, removing the old wick assembly 175 from the water tray 34, and placing the new wick assembly 175 concentrically over the wick assembly locator 186. The housing 88 is then repositioned over the wick assembly 175, wherein the top 182 of the wick filter 176 is received within the receiving shield 126 proximate the fan 119.

The user then removes the tank 16 from the base 12 by simply lifting up on the handle 248. The tank 16 is inverted and the cap 206 rotated in a first direction by approximately 90 degrees wherein the first locking tabs 212 disengage the second locking tabs 214. The cap 206 may then be pulled in an axial direction away from the bottom wall 196 of the tank 16, exposing the aperture 200. The tank 16 is then supplied with water from an appropriate water source, such as the faucet at a sink, by passing water through the aperture 200. The cap 206 is next axially aligned with the aperture 200 and rotated in a second direction by approximately 90 degrees, wherein cooperation between the ramp surfaces 216 and the first locking tabs 212 cause locking and sealing engagement between the lip 210 and flange 204 through the gasket 208.

The tank 16 is returned to the humidifier 10 by preferably carrying it by the handle 248. The concave side wall 190 provides clearance for the leg of the user, while the positioning of the support portion 249 of the handle 248 relative to the center axis 246 causes the concave side wall 190 to pivot in a direction upwardly and toward the convex side wall 192, thereby swinging the tank 16 away from the leg of the user. The tank 16 is then inverted and repositioned on the side wall 20 of the base 12 above the water tray 34.

With the tank 16 properly positioned by the locating pegs 232, 234 and 236 and peripheral flange 244, the valve actuator 230 in the water tray 34 pushes the valve plunger 219 upwardly to move the seal 220 away from the discharge opening 226 of the cap 206. Water then flows from the tank 16 through the discharge opening 226 into the water receiving portion 40 of the water tray 34. As water escapes from the tank 16, air simultaneously enters the tank 16 through the discharge opening 226. The water level rises within the water tray 34 until reaching the level of the bottom wall 224 of the cap 206. At that time, water seals the air path into the tank 16 and prevents further discharge of water therefrom.

Water in the water receiving portion 40 of the water tray 34 flows to the lower evaporative portion 42 and float reservoir 44 due to the gradient therebetween. Water within the evaporative portion 42 is absorbed by a lower portion 184 of the wick filter 176 and drawn by capillary action upward into an upper portion 182 thereof. The water contained in the upper end 182 of the wick filter 176 is positioned within the air flow path 112. More particularly, air driven by the fan 118 passes from the air inlets 100 and 102 and through the side wall 180 of the wick filter 176 thereby accelerating the evaporation of the water within the wick filter 176. The humidified air is then forced out through the open upper end 182 of the wick filter 176 and out through the air exhaust outlet 106, thereby causing the desired humidification effect.

As water is depleted from the water tray 34, the water level attempts to fall but exposes the bottom wall 224 of the cap 206 to allow air to enter the tank 16 and thereby permitting water to escape therefrom. In this respect, the water level in the water tray 34 is self regulating in that it is maintained at its normal operating level until such time as the tank's water supply has been substantially depleted.

Power is supplied to the processor 136, display 132 and humidity sensor 134 as soon as an electrical connection is established with the power cord 164. The humidity sensor 134 continuously detects the ambient air relative humidity and supplies a measured humidity signal indicative thereof to the processor 136. The processor then converts the signal to an appropriate reading within the display 132.

Activation of the motor 118 driving the fan 119 is established by turning the motor control knob 142 from an off position to a desired fan speed position, thereby applying supply voltage to the motor 118. At this point, the processor 136 activates the power indicator lamp 146. A desired or set relative humidity is established by depressing the set point up and set point down buttons 138 and 140 until the desired relative humidity is indicated on the display 132. In the preferred embodiment, the set point up and set point down buttons 138 and 140 increment the set point relative humidity by five percent increments. Once the processor 136 determines that the measured humidity signal as supplied from the humidity sensor 134 equals the set point relative humidity, it deactivates the motor 118. When the processor 136 receives a measured humidity signal a predetermined number of percentage points below the set point relative humidity, it then reactivates the motor 118. In the preferred embodiment the predetermined number of percentage points equals two.

In response to changes in the level of water within the water tray 34, the buoyant float 66 and vertically extending switch actuator 68 move in a vertical direction as guided by the cover 58 supported on the side wall 38. When the level of the water within the water tray 34 is at a predetermined sufficient level, the switch engaging blade 74 of the vertically extending switch actuator 68 is moved into an activating position for depressing the lever arm 152 of the float switch 150 into its active closed position. The processor 136 observes this condition and thereby allows operation of the motor 118.

However, when the water level within the water tray 34 falls below the predetermined sufficient level, the buoyant float 66 and vertically extending switch actuator 68 move downwardly wherein the blade 74 of the elongated member

68 disengages the lever arm 152 of the float switch 150. The switch 150 is thereby returned to its inactive open condition, which again is observed by the processor 136. Further, separation of the blower assembly 14 from the float assembly 48 will cause disengagement of the lever arm 152 and return of the float switch 150 to its inactive open condition. When the processor 136 observes the float switch 150 in its open position, it activates the refill indicator lamp 148 and deactivates the motor 116.

When routine cleaning of the water contacting components is required, the blower assembly 14 and tank 16 are simply removed from the supporting base 12. The cap 206 is next removed from the bottom wall 196 of the tank 16. The wick assembly 175 is then removed from the water tray 34 and replaced, if required. The float assembly 48 is easily removed from the water tray 34 by disengaging the cover 58 from the side wall 38. Next, the water tray 34 is lifted by its handle 188 upwardly and away from the base. The tank 16, including removed cap 206, along with the float assembly 48 and water tray 34 are then preferably placed within a conventional dishwasher for cleaning. As noted above, these dishwashable components are easily identified by the color distinction from other components of the humidifier 10.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. A humidifier comprising:

a base including a bottom wall;

a water tray including a bottom wall and a side wall extending upwardly from said bottom wall, said water tray removably supported by said bottom wall of said base;

a humidification unit including a housing supported by said base; and a tank removably supported by said base, said tank including side and bottom walls and an interior chamber in fluid communication with said water tray, said water tray and said tank are a first color and said base is a second color, said second color being visibly distinguishable from said first color;

wherein said water tray and said tank are formed of a dishwasher safe thermoplastic material.

2. A humidifier comprising:

a base including a bottom wall;

a water tray including a bottom wall and a side wall extending upwardly from said bottom wall, said water tray removably supported by said bottom wall of said base;

a float assembly supported by said water tray, said float assembly including a buoyant float movable relative to said bottom wall of said water tray;

a humidification unit including a housing supported by said base; and a tank removably supported by said base, said tank including side and bottom walls and an interior chamber in fluid communication with said water tray;

wherein said water tray and said tank are formed of a dishwasher safe thermoplastic material.

3. The humidifier of claim 2 wherein said float assembly is formed of a dishwasher safe thermoplastic material.

4. The humidifier of claim 3 wherein:

said water tray, said float assembly and said tank are a first color; and said base is a second color, said second color visibly distinguishable from said first color.

* * * * *